US010161709B1

(12) United States Patent
Wright

(10) Patent No.: US 10,161,709 B1
(45) Date of Patent: Dec. 25, 2018

(54) SMALL ARMS INTEGRATION SYSTEM

(71) Applicant: Jimmie L. Wright, Rockledge, FL (US)

(72) Inventor: Jimmie L. Wright, Rockledge, FL (US)

( * ) Notice: Subject to any disclaimer, the term of this patent is extended or adjusted under 35 U.S.C. 154(b) by 0 days.

(21) Appl. No.: 15/686,123

(22) Filed: Aug. 24, 2017

Related U.S. Application Data

(60) Provisional application No. 62/378,703, filed on Aug. 24, 2016.

(51) Int. Cl.

| | |
|---|---|
| ***F41C 23/00*** | (2006.01) |
| ***F41C 9/00*** | (2006.01) |
| ***F41A 19/18*** | (2006.01) |
| ***F41C 3/00*** | (2006.01) |
| ***F41C 7/00*** | (2006.01) |
| ***F41A 19/21*** | (2006.01) |

(52) U.S. Cl.
CPC ..... *F41C 9/00* (2013.01); *F41A 19/183* (2013.01); *F41A 19/21* (2013.01); *F41C 3/00* (2013.01); *F41C 7/00* (2013.01)

(58) Field of Classification Search
CPC F41A 11/02; F41A 19/08; F41A 19/09; F41C 27/00
USPC ..... 42/72, 106, 69.01
See application file for complete search history.

(56) References Cited

U.S. PATENT DOCUMENTS

| | | | | |
|---|---|---|---|---|
| 4,275,640 | A | 6/1981 | Wilhelm | |
| 4,856,410 | A | 8/1989 | Anderson | |
| 4,867,039 | A | 9/1989 | Dobbins | |
| 4,932,148 | A | 6/1990 | Barrett | |
| 5,216,191 | A | 6/1993 | Fox | |
| 5,386,659 | A | 2/1995 | Vaid et al. | |
| 5,502,914 | A | 4/1996 | Moon | |
| 5,717,156 | A | 2/1998 | Lenkarski | |
| 5,834,678 | A | 11/1998 | Kalb | |
| 6,401,379 | B1 | 6/2002 | Moon | |
| 6,405,473 | B1 | 6/2002 | Petig et al. | |
| 6,481,144 | B1 | 11/2002 | Chee et al. | |
| 6,775,941 | B1 | 8/2004 | McNulty, Jr. | |
| 7,047,684 | B2 | 5/2006 | Roh | |
| 7,194,833 | B1 | 3/2007 | Curry | |
| 7,225,574 | B2 | 6/2007 | Crandall et al. | |
| 7,552,557 | B1 * | 6/2009 | Mabry | F41A 11/04 42/71.01 |
| 8,371,056 | B1 * | 2/2013 | Baker | F41G 11/003 42/106 |
| D693,420 | S | 11/2013 | Abbott et al. | |
| 8,683,726 | B1 | 4/2014 | Genton | |
| 8,739,452 | B1 * | 6/2014 | Calvert | F41G 11/004 42/106 |
| 8,763,295 | B2 * | 7/2014 | Trimble | F41A 23/02 42/72 |
| 9,200,857 | B1 | 12/2015 | Kellgren | |
| 9,534,861 | B1 | 1/2017 | Kellgren | |

(Continued)

*Primary Examiner* — J. Woodrow Eldred

(74) *Attorney, Agent, or Firm* — Nelson Mullins Riley & Scarborough, LLP

(57) ABSTRACT

Systems, devices, apparatus and methods for providing a semi-automatic rifle with ammunition magazine, having a docking port/station for allowing a semi-automatic pistol to be inserted. The trigger on the pistol can be used to fire the rifle and use the rifle ammunition. When the rifle ammunition is depleted, the pistol can be removed and separately fired using its' own ammunition.

13 Claims, 10 Drawing Sheets

(56) References Cited

U.S. PATENT DOCUMENTS

| | | | | |
|---|---|---|---|---|
| 2004/0244261 | A1 | 12/2004 | Roh | |
| 2005/0188593 | A1* | 9/2005 | Cerovic | F41A 19/58 42/77 |
| 2005/0235546 | A1 | 10/2005 | Wonisch et al. | |
| 2006/0150467 | A1 | 7/2006 | Poulin et al. | |
| 2014/0360076 | A1 | 12/2014 | Zamlinsky | |

* cited by examiner

SMALL ARMS INTEGRATION SYSTEM

CROSS REFERENCE TO RELATED APPLICATION

This application claims the benefit of priority to U.S. Provisional Application Ser. No. 62/378,703 filed Aug. 24, 2016, the entire disclosure of which is incorporated by reference in its' entirety.

FIELD OF INVENTION

This invention relates to firearms, and in particular to systems, devices, apparatus and methods for providing a semi-automatic rifle with ammunition magazine, having a docking port/station for allowing a semi-automatic pistol to be inserted, where the trigger on the pistol is used to fire the rifle and use the rifle ammunition, and when the rifle ammunition is depleted, the pistol can be removed and separately fired using its' own ammunition.

BACKGROUND AND PRIOR ART

In close quarter combat (CQB) environments, military and law enforcement persons prefer to use semi-automatic or automatic rifles over semi-automatic pistols and handguns. However, the rifles can easily run out of ammunition in an active firefight. In addition to the dangerous environment, there are further problems if the persons are out in the open and not able to go behind a secure barrier when they need to reload ammunition into their rifle. In these situations, a delay of seconds can cause serious harm to those in military and law enforcement positions.

Other problems can occur when storing and transporting semi-automatic or automatic rifles loaded with ammunition, since it is easier to have an accidental discharge of their weapon when it is fully loaded.

A semi-automatic pistol generally uses the energy of the fired cartridge to cycle the action of the firearm and advance the next available cartridge into position for firing. One round is fired each time the trigger of a semi-automatic pistol is pulled. Semi-automatic pistols harness the energy of one shot to reload the chamber for the next. After a round is fired, the spent casing is ejected and a new round from the magazine is loaded into the chamber, allowing another shot to be fired as soon as the trigger is pulled again. Most types of semi-automatic pistols rely on a removable magazine to store ammunition before it is fired, usually inserted inside the grip. However, the pistols are not considered to be the first firearm of choice in close quarter combat (CQB) environments.

A Bullpup rifle is a firearm with its action behind its trigger group. This configuration permits a shorter overall weapon for a given barrel length. This maintains the advantages of a longer barrel in muzzle velocity and accuracy, while improving maneuverability and reducing weight. The entire magazine is often also located behind the trigger group, though it is only necessary for the weapon's feed location to be located there for it to be classified as a Bullpup. Being held closer to the body, a bullpup causes less arm fatigue and allows faster reaction time from a lowered position. However, the traditional Bullpup rifle also must be reloaded, which can add additional dangers in close quarter combat (CQB) environments where the enforcement personal runs out of ammunition while out in the open and would need time to reload.

Thus, the need exists for solutions to the above problems with the prior art.

SUMMARY OF THE INVENTION

A primary objective of the present invention is to provide systems, devices, apparatus and methods for combining a semi-automatic rifle with a semi-automatic pistol, where the pistol trigger can be initially used to fire the rifle and when the rifle ammunition is depleted, the pistol can be quickly and easily removed and fired with its' own ammunition.

A secondary objective of the present invention is to provide systems, devices, apparatus and methods for providing an extra fully loaded weapon that can be simply, easily and quickly used after a rifle's magazine is emptied.

A third objective of the present invention is to provide systems, devices, apparatus and methods for allowing a quick transition from a rifle to a handgun when needed.

A fourth objective of the present invention is to provide systems, devices, apparatus and methods for safely storing a rifle having ammunition that is only operational when a handgun is attached.

A fifth objective of the present invention is to provide systems, devices, apparatus and methods for a semi-automatic rifle having lowered recoil due to having the weight of a fully loaded handgun located toward the front of the rifle.

A sixth object of the present invention is to provide systems, devices, apparatus and methods for providing military and law enforcement a safer and quicker access to a loaded weapon when a rifle magazine becomes depleted.

The new rifle will be without the traditional trigger mechanism built into the weapon. A docking space for the semi-automatic handgun will be located in the space that normally houses the pistol grip and trigger. Once connected and locked into the bullpups lower receiver, the semi-automatic handgun and rifle can become an integrated weapon system.

A firearm system for transitioning from a rifle to a pistol, can include a rifle having a barrel end with forward grip and a rear end, a longitudinal port in a bottom of the rifle between the forward grip and the rear end, a firing mechanism in the rifle, a moveable lever having an upper end portion attached to the firing mechanism and a lower end portion and a pistol having a trigger, wherein inserting an upper end of the pistol into the longitudinal port opening in the bottom of the rifle, allows for the trigger of the pistol to be adjacent the lower end portion of the lever, and pulling the pistol trigger causes the moveable lever to move causing the firing mechanism to fire the rifle.

The rifle can include a magazine having ammunition, wherein the pulling of the pistol trigger causes the ammunition in the rifle magazine to be used.

The pistol can include separate ammunition that is not used when the rifle magazine is used.

The rifle can include a modified bullpup rifle body without a trigger and a handgrip.

A pistol can include a double-action semi-automatic pistol.

The moveable lever can include a pivot member between the upper end portion and the lower end portion, for allowing the moveable lever to rotate counter-clockwise relative to the pivot member when the pistol trigger is pulled.

The lower end portion of the moveable lever can abut against a rear side of the pistol trigger. The lower end portion of the moveable lever can also be attached to the pistol trigger.

The fore grip on the rifle can include a longitudinal member with a front end and a rear end, the longitudinal member being slideable forward and backward to the barrel end of the rifle, a pivot member for allowing the rear end of the fore grip to pivot up and down relative to the barrel end of the rifle and a cavity for allowing a barrel end of the pistol to be positioned therein.

The forward grip can include a front height adjustment member for adjusting height of the barrel end of the pistol inside of both the cavity in the fore grip and inside the longitudinal port in the bottom of the rifle.

The fore grip can include a front width adjustment member for fixing a spacing width between the barrel end of the pistol and inside walls of the cavity of the fore grip.

The firearm system can include a rear height adjustment member adjusting height of a rear end of the pistol inside of the longitudinal port in the bottom of the rifle.

The firearm system can include a rear width adjustment member for fixing a spacing width between a rear end pistol inside of the longitudinal port in the bottom of the rifle.

A novel firearm system can include a rifle having a barrel end with forward grip and a rear end, a firing mechanism in the rifle; and an ammunition magazine attached to the rifle, wherein the rifle when fully loaded with the ammunition magazine can be safely stored and transported and is not operational without a separate handgun being attached to the rifle.

The firearm system can include a docking station underneath the rifle between the forward grip and the rear end, and a pistol having a trigger, wherein attaching the pistol to the docking station under the rifle, wherein pulling the pistol trigger causes the firing mechanism on the rifle to be fired using the ammunition magazine on the rifle.

The rifle can include a pivoting lever having an upper end portion attached to the firing mechanism of the rifle and a lower end portion adjacent to the pistol trigger, wherein pulling the pistol trigger causes the firing mechanism to fire the rifle.

The fore grip on the rifle can include a longitudinal member with a front end and a rear end, the longitudinal member being slideable forward and backward to the barrel end of the rifle, a pivot member for allowing the rear end of the fore grip to pivot up and down relative to the barrel end of the rifle, and a cavity for allowing a barrel end of the pistol to be positioned therein.

The firearm system can include a height adjustment member for adjusting height of the pistol inside of the docking station under the rifle.

The firearm system can include a width adjustment member for fixing a spacing width of the pistol inside of the docking station under the rifle.

A method for allowing a quick transition from a rifle to a handgun can include the steps of providing a rifle with a fore grip barrel and a rear end, ammunition internal trigger mechanism to fire the rifle, and a docking station underneath, providing a pistol having a trigger, inserting the pistol into the docking station under the rifle, pulling the pistol trigger to fire the ammunition from the rifle, removing the pistol from the docking station and firing the pistol using ammunition for the pistol.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
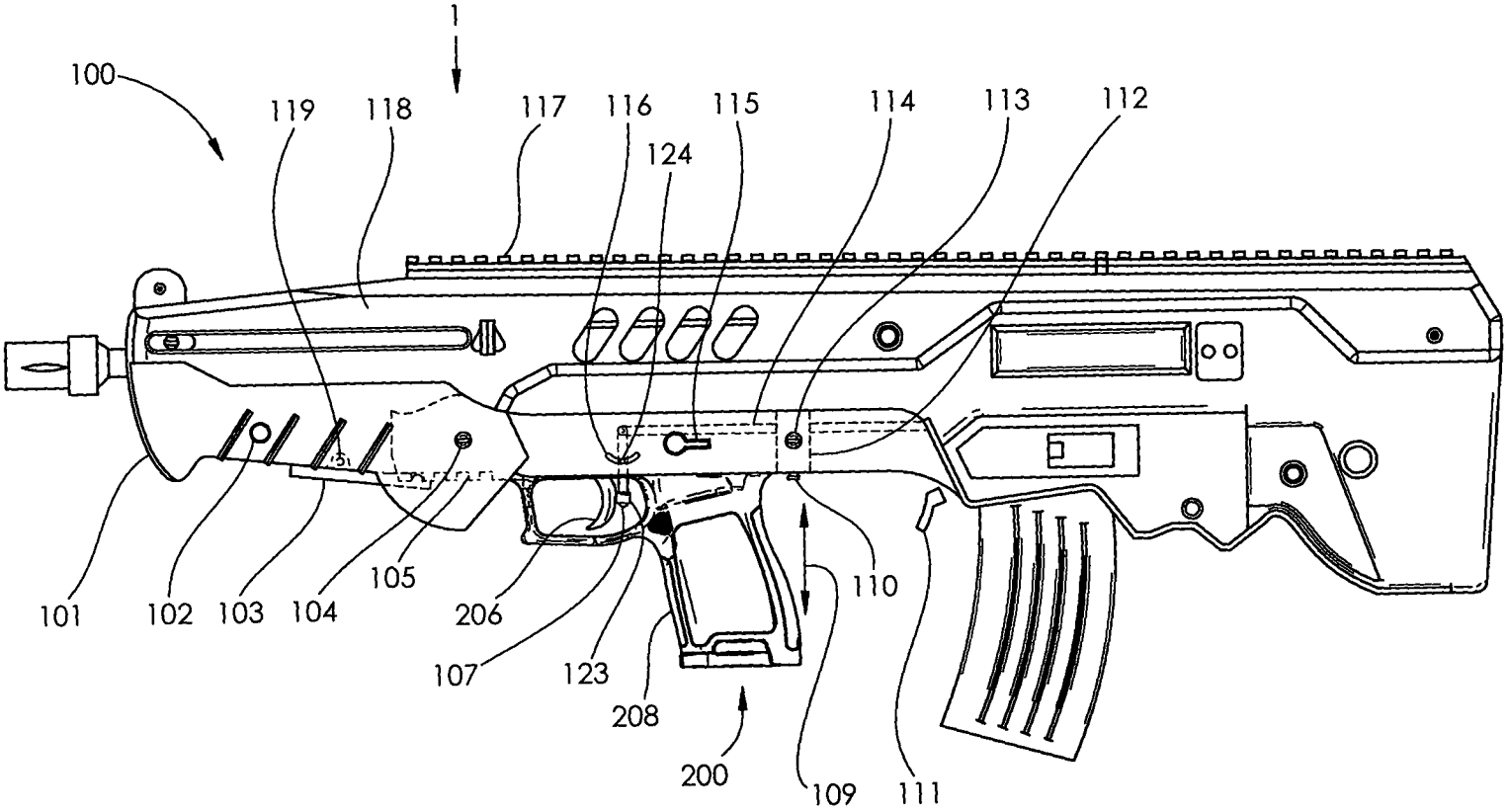
FIG. 1 is a front view of an assembled rifle with attached pistol.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 Integrated weapon system
100 Modified rifle with docking station
101 Sliding fore grip
102 Push button fore grip release
103 Bottom lock
104 Width adjustment screw
107 Trigger lever/linkage

108 Pivoting pin between trigger lever/linkage and rifle internal trigger linkage
109 Height adjustment movement
110 Height adjustment movement screw
111 Magazine release
112 Height adjustment (U) shaped bracket
113 Width adjustment screw
114 Rifle internal trigger linkage
115 Rifle safety
116 Adjustable trigger channel
117 Picatinny rails on top of rifle
118 Rifle upper receiver
119 Bottom lock pivot pin
120 Spring
121 Pivot pin hole
122 Picatinny locking lug
123 Trigger tab/attachment
124 Adjustable trigger screw
127 Width movement
140 Cavity/cut-out opening in rear end of fore grip
150 Sliding fore grip movement
160 Port/docking station under rifle
200 Pistol/handgun
206 Trigger for pistol/handgun
208 Handgun pistol grip
228—Picatinny rail under barrel of pistol/handgun
240 Horn (backstrap) on rear end of pistol/handgun
250 Slide on handgun/pistol FIG. 1 is a front view of a novel rifle 100 with attached pistol 200.

Figure 2:
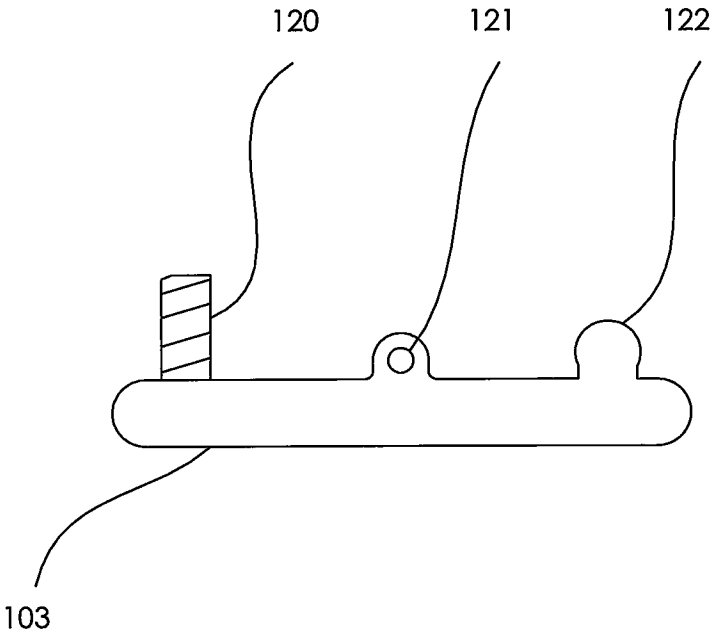
FIG. 2 is an enlarged view of the bottom lock used with the novel rifle with attached pistol of FIG. 1.

FIG. 2 is an enlarged view of the bottom lock 103 used with the novel rifle 100 with attached pistol 200 of FIG. 1.

Figure 3A:
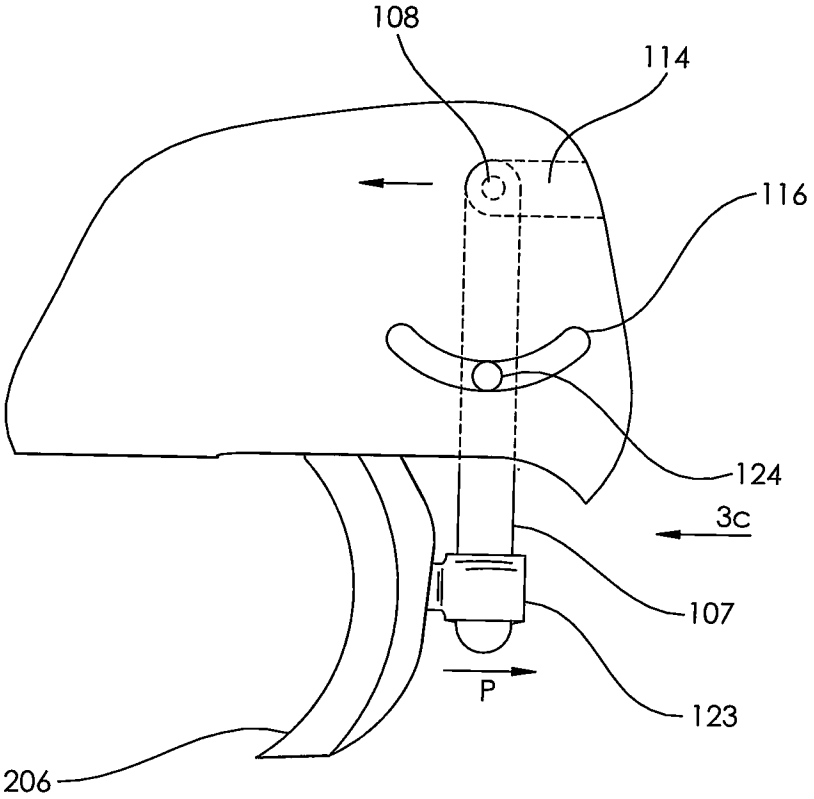
FIG. 3A is an enlarged view of the pistol trigger with trigger lever and lever linkage in the rifle of FIG. 1 in an initial ready to fire position.
Figure 3B:
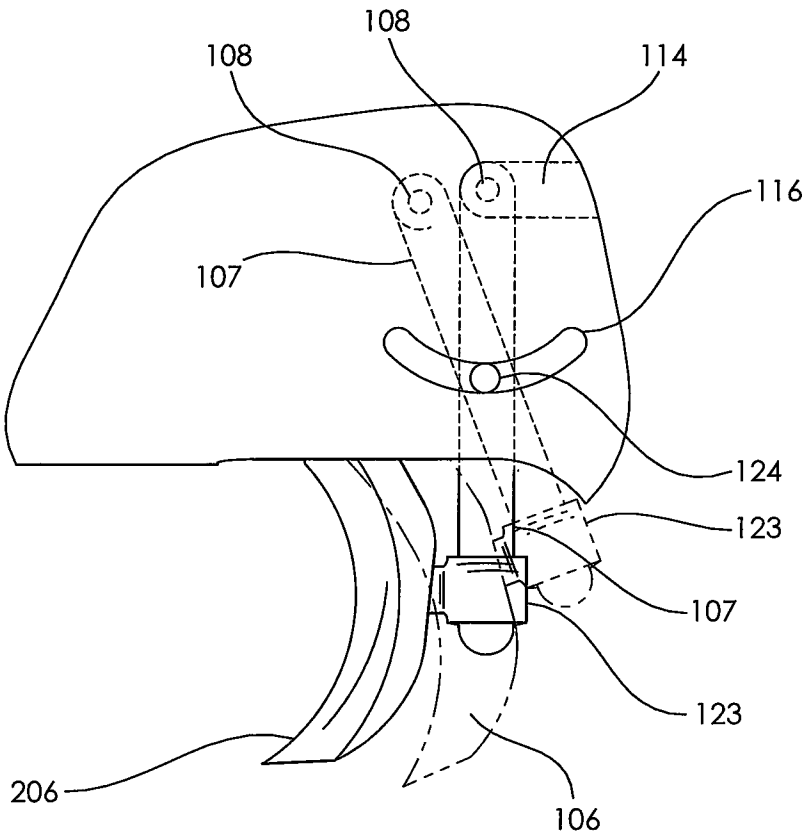
FIG. 3B is another view of FIG. 3A with dotted lines indicating the trigger pulled to a fire position with the pivoting trigger lever, tab and internal linkage.
Figure 3C:
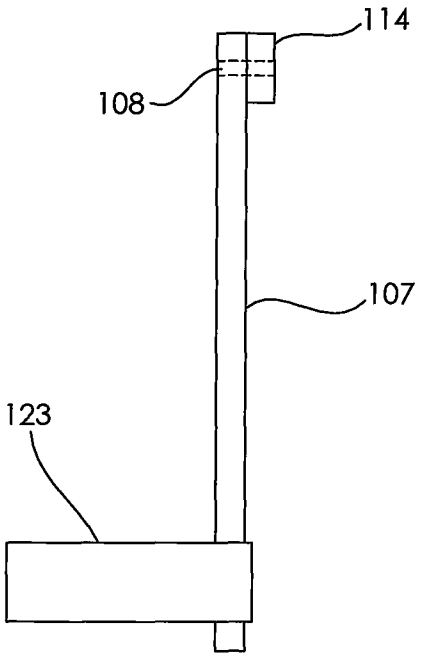
FIG. 3C is a rear view of the pivoting trigger lever and trigger tab of FIG. 3A.

FIG. 3A is an enlarged view of the pistol trigger 206 with trigger lever/linkage 107, pivoting pin 108 and lever linkage 114 in the rifle 100 of FIG. 1 in an initial ready to fire position. FIG. 3B is another view of FIG. 3A with dotted lines indicating the trigger 206 pulled to a fire position with the pivoting trigger lever 107, tab 123 and internal rifle trigger linkage 114. FIG. 3C is a rear view of the pivoting trigger lever/linkage 107 and trigger tab 123 of FIG. 3A.

Figure 4:
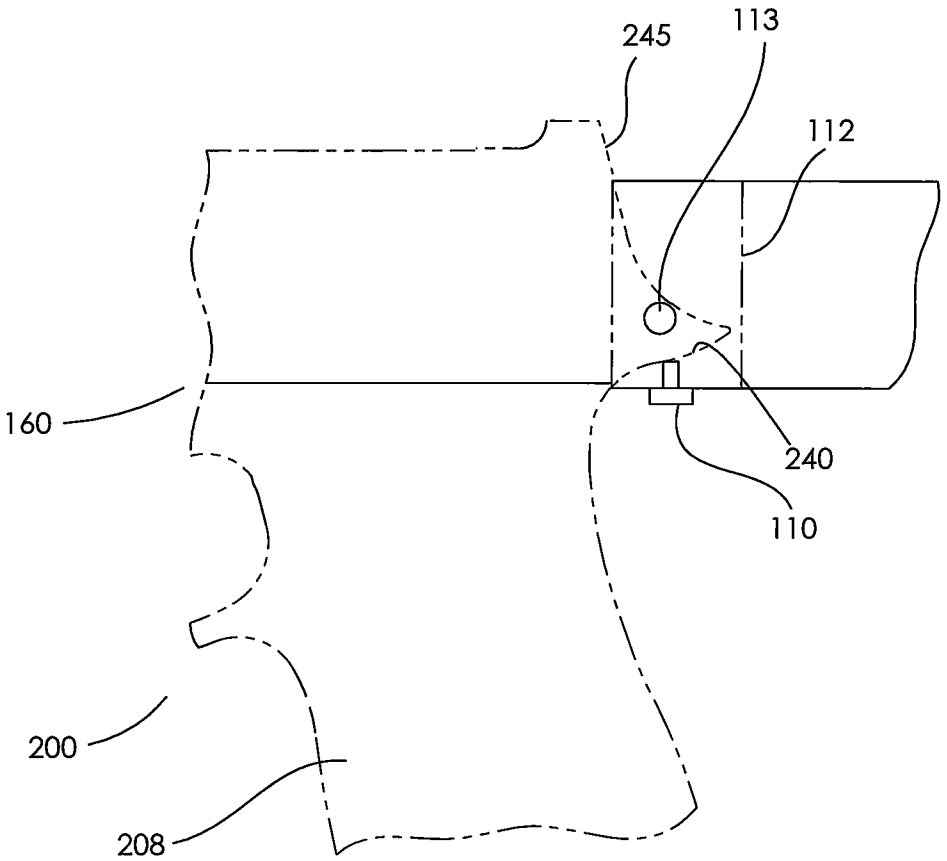
FIG. 4 is an enlarged view of the pistol horn (backstrap) height adjusted inside of the rear of the rifle port being width adjusted.

FIG. 4 is an enlarged view of the pistol horn (backstrap) 240 being height adjusted by height adjustment screw 110 inside of the rear of the rifle port/docking station 160 with width adjustment screw 113.

Figure 5:
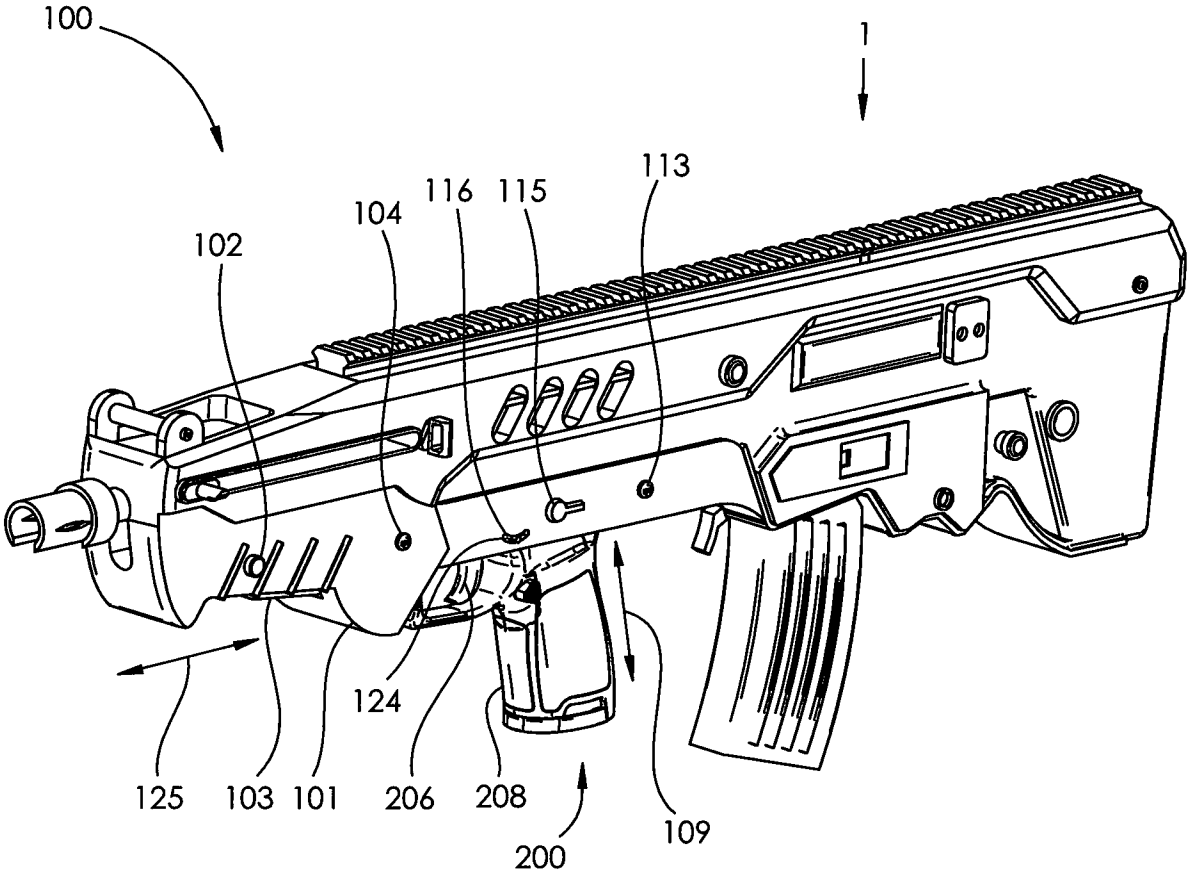
FIG. 5 is a left front perspective view of the rifle with attached pistol of FIG. 1.
Figure 6:
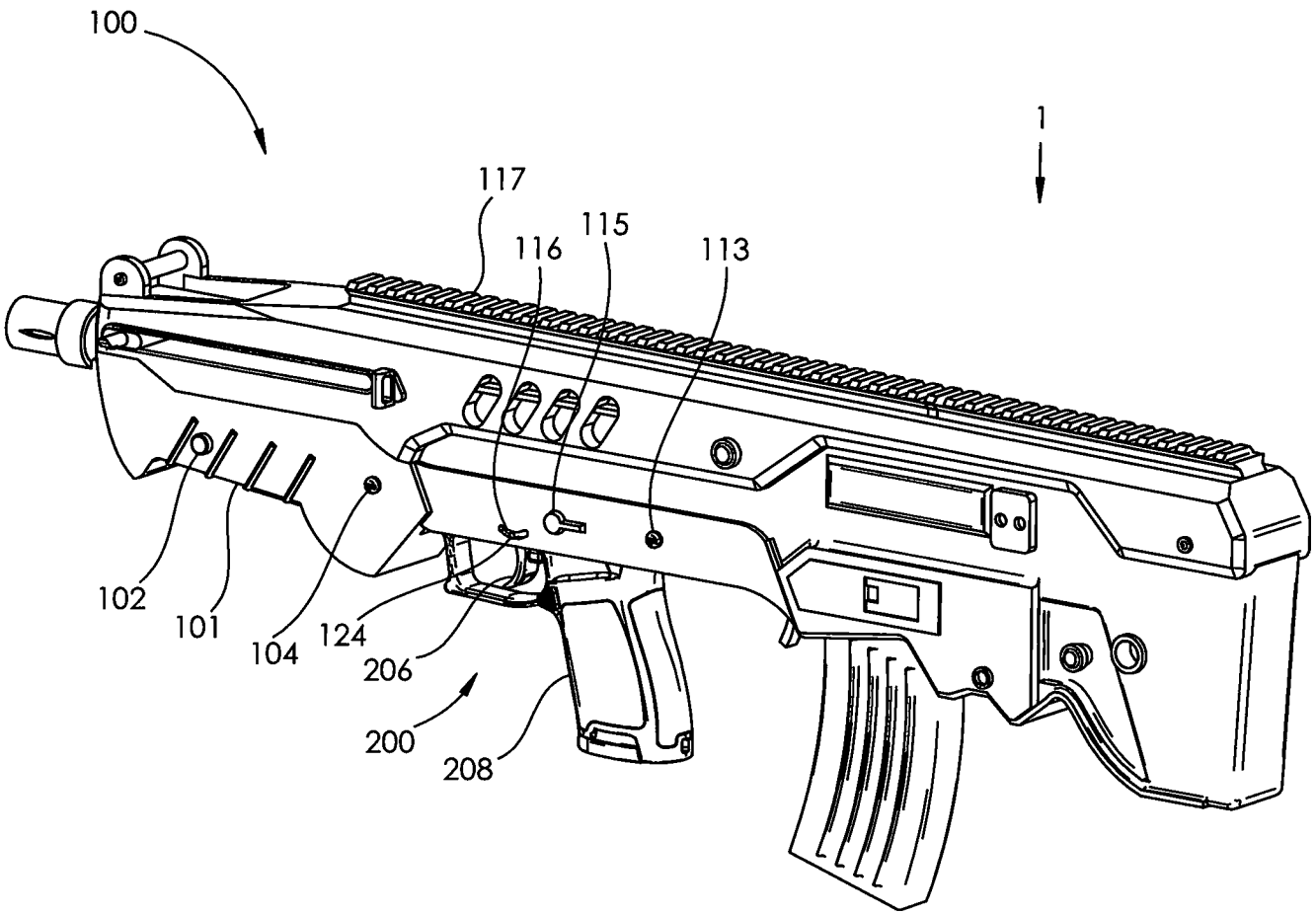
FIG. 6 is a right front perspective view of the rifle with attached pistol of FIG. 1.
Figure 7:
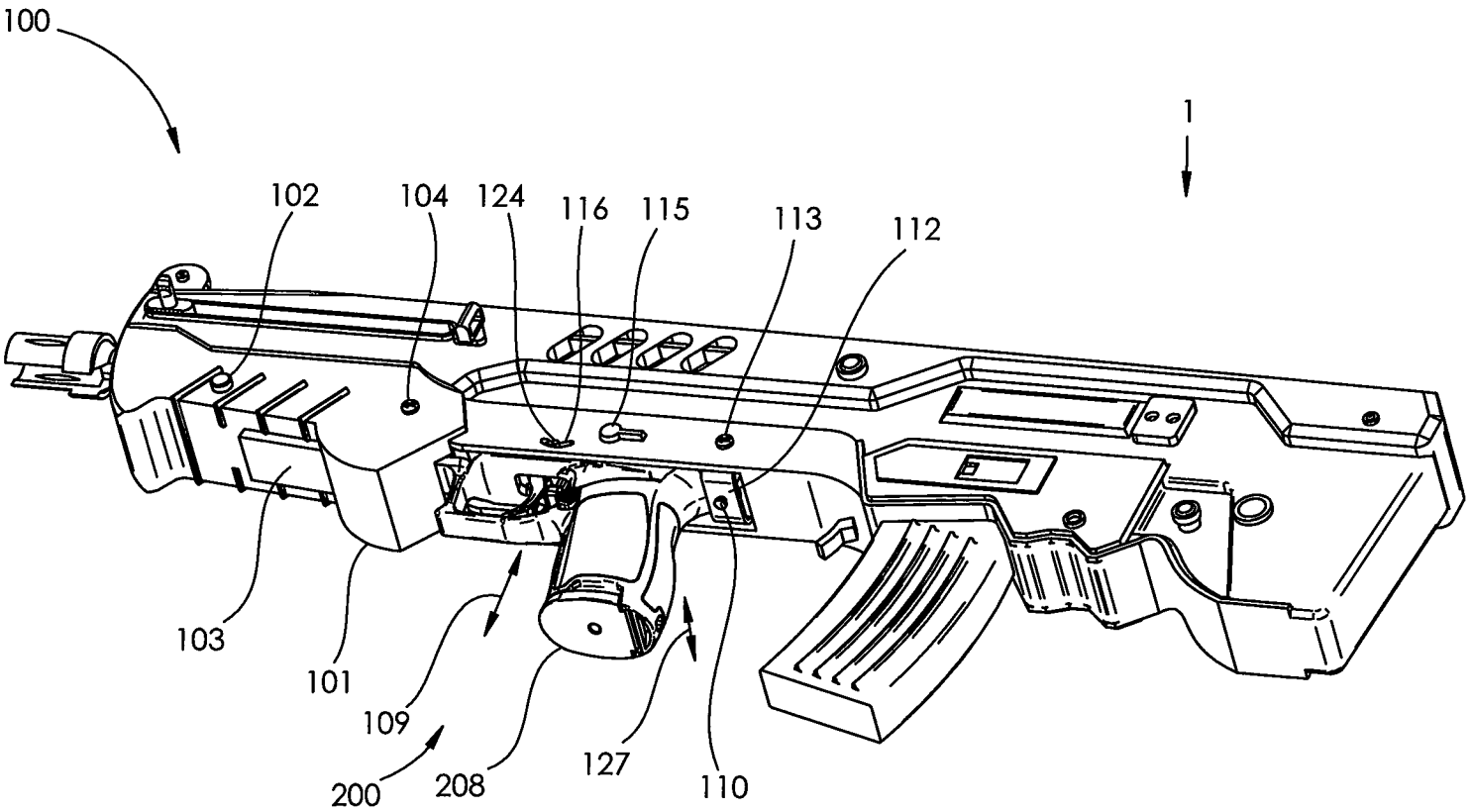
FIG. 7 is a bottom front perspective view of the rifle with attached pistol of FIG. 1.

FIG. 5 is a left front perspective view of the rifle 100 with attached pistol 200 of FIG. 1. FIG. 6 is a right front perspective view of the rifle 100 with attached pistol 200 of FIG. 1. FIG. 7 is a bottom front perspective view of the rifle 100 with attached pistol 200 of FIG. 1.

Figure 8:
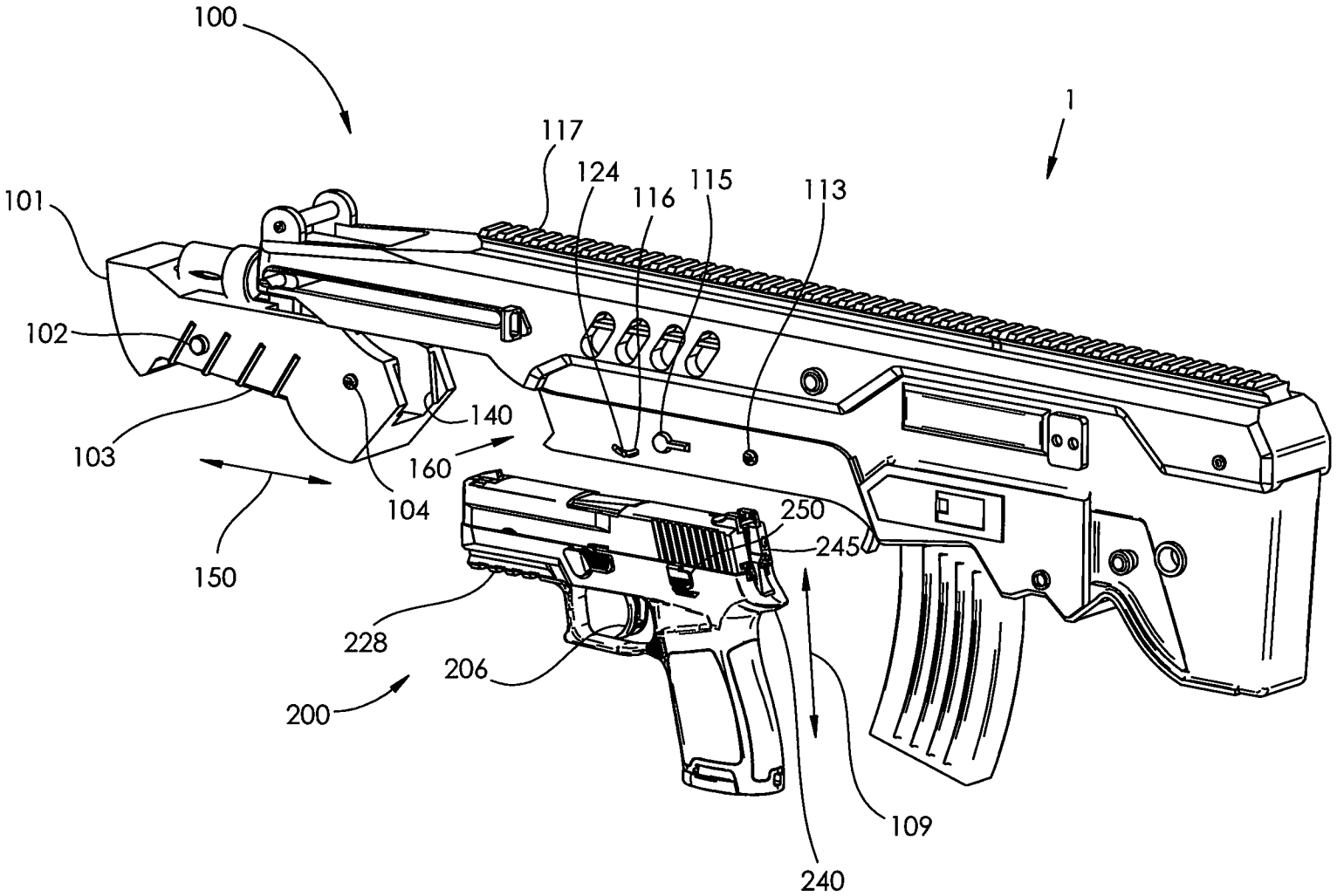
FIG. 8 is an exploded view of the pistol detached from the rifle of FIG. 5.

FIG. 8 is an exploded view of the pistol 200 detached from the rifle 100 of FIG. 5.

Referring to FIGS. 1 and 5-8, rifle 100 can include a bullpups type rifle that has been modified and substantially altered. A bullpup's rifles configuration generally includes picatinny rails 117 on top of a receiver 118, bolt carrier group and ammunition magazine with magazine release 111 which is placed behind the pistol grip. This shortens the firearm's overall length without sacrificing barrel length. Types of bullpup rifles that can be used with this invention can be semi-automatic and automatic weapons, such as but not limited to those described in U.S. Pat. No. 5,834,678 to Kalb; U.S. Pat. No. 7,047,684 to Roh and U.S. Published Patent Application 2005/0235546 to Wonisch, which are each incorporated by reference in their entirety. In a preferred embodiment, the existing bullpup pistol grip with associated bullpup rifle trigger has been removed.

The novel integrated weapon system 1 will eliminate the bullpup rifles pistol grip and replace it with a port/docking station 160 that accepts an operational handgun 200 with pistol grip 208 and trigger 206, such as but not limited to a semi-automatic pistol, such as a Smith and Wesson M&P. Types of pistols that can be used include but are not limited to those shown and described, in U.S. Pat. No. 5,717,156 to Lenkarski; U.S. Pat. No. 6,405,473 to Petig and U.S. Published Patent Application 2006/0150467 to Poulin, which are each all incorporated by reference in their entirety.

This system 1 is a fully adjustable rifle 100 that has the ability to accept most double action semi-automatic pistols 200. Inserting the pistol 200 into the docking port/docking station 160 located underneath the rifle 100 will bring the rifle into functional operation status. The pistol 100 generally should be configured with the slide 250 locked to the rear.

Referring to FIGS. 1-8, there are several steps to lock the pistol/handgun 200 with the rifle 100.

First, pull down the retracted trigger lever/linkage 107 which is pivotally attached by pin 108 to rifle internal trigger linkage 114. Next, tilt the pistol 200 forward (down) and insert the upper rear end 245 of the pistol 200 into the port/docking station 160 so that the horn (backstrap) 240 of the pistol 200 is above the height adjustment U shaped bracket 112 (FIG. 4). Once the rear of the pistol is inserted into the docking port/docking station 160 of the rifle 200, the user can adjust the rifle 100 to fit the handgun 200.

The adjustments can include adjusting the height of the rear end 245 of the pistol/handgun 200 (in the direction of height adjustment movement arrow 109) by rotating screw 110 so that the threaded tip end of the screw 110 pushes the rear end 245 of the pistol to abut against an interior ceiling in the docking port/station 160.

Additionally, the user can adjust the rear end 245 of the pistol to fit inside the larger width opening in the docking port/station 160 by adjusting width adjustment screw 113 that the threaded tip end of the screw 113 pushes the rear end 245 of the pistol 200 against an interior side wall inside of the docking port/station 160 as shown in arrows 127.

Next, the user can rotate the front barrel end of the pistol/handgun 100 up into the rifles front docking port/station 160 and slide the cavity/cut-out opening 140 of forearm grip 101 to the right in the right direction of double arrow 150 (FIG. 8) about the barrel end having the pistols picatinny rail 228, which is located on the bottom of the pistols 200 lower receiver. To release the pistol/handgun 200, a switch 102, such as but not limited to a release button can be depressed to release an internal catch to allow the fore grip 101 to slide back. The slidable fore grip 101 can slide similar to the pump slide handle on shot gun, such as those shown and described in U.S. Pat. No. 4,867,039 to Dobbins and U.S. Pat. No. 6,775,941 to McNulty, Jr., which are each incorporated by reference in their entirety.

Referring to FIGS. 1, 2 and 5-8, a bottom lock 103 having a rectangular plate configuration can have a forward end with a spring 120 which having a front end attached to an internal roof portion inside cavity/cut-out 140. A mid-portion of the bottom lock/plate 103 can be pivotally attached to internal opposite sides of the cavity/cut-out 140 by a pivot pin 119 that passes through pivot pin hole 121 in the bottom lock/plate 103. The outwardly expanding spring 120 can pivot upwardly facing protrusion(s) 122 on the rear of the bottom lock/plate 103 forming a locking lug 122, which can press into any of the parallel grooves (picatinny rail channel/groove 205) in the picatinny rails 228 along the underside of the barrel end of the pistol 200. The locking lug 122 fit into one of the grooves/channels 205 of the picatinny rails 228 forms a height adjustment to fix the height of the front barrel end of the pistol 200 to abut against an interior ceiling surface portion inside of the cavity/cut-out 140 of the fore grip 101.

Next, the user can rotate a width adjustment screw 104 in the side of the foregrip 101 so that the threaded tip end abuts against a side portion of the barrel end of the pistol 200 pushing the barrel of the pistol 200 against an opposite internal side wall inside of the cavity/cut-out 140 of the foregrip 101.

Referring to FIGS. 1, 3A-3C and 5-8, the user can connect the trigger 206 to the rifles existing internal trigger linkage 114 inside of the rifle 100. The horizontally moving rifle internal trigger linkage 114 has been modified to have an outer end with a pivot pin 108 which is pivotally attached to a vertical trigger lever linkage 107. The bottom of the trigger lever linkage 107 can have a side facing tab/attachment 123. A screw 124 having a tip end that remains pivotally attached to a mid-portion of trigger lever/linkage 107 can slide to the right or left within adjustable trigger channel 116. The user can move the lever/linkage 107 until side facing tab 123 abuts against a back of the pistol trigger 206. When the tab 123 abuts against the back of pistol trigger 206, the user can then tighten screw 124 locking the position of pivotal pin portion of where lever/linkage 107 is continuously pivotal relative to the side walls of docking port/station 160.

At this point the modified rifle 100 has become fully function utilizing the pistol/handguns trigger 106. The handgun 106 has been taken out of battery and can only function as the rifles 200 trigger in this configuration. If at any time the pistol/handgun 200 is removed from the rifles docking port/station 160 the rifle 100 will be placed on safe 115 (utilizing the rifles existing safety) and considered out of operation. The handguns 200 slide 250 can be released, a round chambered, and placed back into service and utilized as a standalone weapon.

This system will utilize a semi-automatic handgun's trigger mechanism to fire the rifle 100. The rifle 100 can be a fully functional weapon system only when accompanied with a compatible semi-automatic handgun 200. The two 100 and 200 will create a marriage when the handgun's slide 250 has been locked to the rear position which allows the trigger mechanism 114 of the rifle 100 to be linked to the handguns trigger bar. Once the trigger connection has been made, the semi-automatic pistol/handgun 200 will then be locked into the docking port/station 160 of the rifle 100 making the rifle 100 fully functional.

In case of depletion of ammunition from the ammunition magazine in the rifle 100, the semi-automatic pistol/handgun 100 can be detached and used as a separate weapon system. During the separation, the semiautomatic pistols/handguns 200 slide 250 will move to the forward position, load a round into the chamber, creating a functional pistol/handgun 200. Once the rifle's 100 ammunition problem has been rectified, the semi-automatic pistol/handgun 200 can be reattached, making the rifle 100 operational again.

The invention can be used with a rifle having any type of caliber.

Although the above references fasteners, such as screws (for example screws 110, 113, 104), other types of fasteners, such as but not limited to bolts, and the like, can also be used.

While the types of rifles referenced include a bullpup rifle, the invention can be used with other types of rifles, and the like.

Although the drawings and description describe double action semi-automatic pistols, the invention can be used with other types of pistols, handguns and the like.

While the embodiments describe a rifle with docking port/station and pistol/handgun, the invention can be used with other weapons such as a crossbow, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A firearm system for transitioning from a rifle to a pistol, comprising:

a rifle having a barrel end with forward grip and a rear end;

a longitudinal port in a bottom of the rifle between the forward grip and the rear end;

a firing mechanism in the rifle;

a moveable lever having an upper end portion attached to the firing mechanism and a lower end portion; and a pistol having a trigger, wherein inserting an upper end of the pistol into the longitudinal port opening in the bottom of the rifle, allows for the trigger of the pistol to be adjacent the lower end portion of the lever, and pulling the pistol trigger causes the moveable lever to move causing the firing mechanism to fire the rifle.

2. The firearm system of claim 1, wherein the rifle includes:

a magazine having ammunition, wherein the pulling of the pistol trigger causes the ammunition in the rifle magazine to be used in the rifle.

3. The firearm system of claim 2, wherein the pistol includes:

separate ammunition that is not used when the rifle magazine is used.

4. The firearm system of claim 1, wherein the rifle includes:

a bullpup rifle body without a trigger and a handgrip.

5. The firearm system of claim 1, wherein the pistol includes:

a double-action semi-automatic pistol.

6. The firearm system of claim 1, wherein the moveable lever includes:

a pivot member between the upper end portion and the lower end portion, for allowing the moveable lever to rotate counter-clockwise relative to the pivot member when the pistol trigger is pulled.

7. The firearm system of claim 6, wherein the lower end portion of the moveable lever abuts against a rear side of the pistol trigger.

8. The firearm system of claim 6, wherein the lower end portion of the moveable lever is attached to the pistol trigger.

9. The firearm system of claim 1, wherein the fore grip on the rifle includes:

a longitudinal member with a front end and a rear end, the longitudinal member being slideable forward and backward to the barrel end of the rifle;

a pivot member for allowing the rear end of the fore grip to pivot up and down relative to the barrel end of the rifle; and a cavity for allowing a barrel end of the pistol to be positioned therein.

10. The firearm system of claim 9, wherein the forward grip includes:

a front height adjustment member for adjusting height of the barrel end of the pistol inside of both the cavity in the fore grip and inside the longitudinal port in the bottom of the rifle.

11. The firearm system of claim 9, wherein the fore grip includes:

a front width adjustment member for fixing a spacing width between the barrel end of the pistol and inside walls of the cavity of the fore grip.

12. The firearm system of claim 1, further comprising:

a rear height adjustment member adjusting height of a rear end of the pistol inside of the longitudinal port in the bottom of the rifle.

13. The firearm system of claim 1, further comprising:

a rear width adjustment member for fixing a spacing width between a rear end pistol inside of the longitudinal port in the bottom of the rifle.

* * * * *